US008225869B2

(12) United States Patent
Beard et al.

(10) Patent No.: US 8,225,869 B2
(45) Date of Patent: Jul. 24, 2012

(54) LOCATOR TOOL AND METHODS OF USE

(75) Inventors: Dana M. Beard, Houma, LA (US); Parish Triche, Houma, LA (US); Larry Tidwell, Alvin, TX (US)

(73) Assignee: GE Oil & Gas Logging Services, Inc., Houston, TX (US)

( * ) Notice: Subject to any disclaimer, the term of this patent is extended or adjusted under 35 U.S.C. 154(b) by 88 days.

(21) Appl. No.: 12/291,225

(22) Filed: Nov. 7, 2008

(65) Prior Publication Data

US 2010/0116492 A1 May 13, 2010

(51) Int. Cl.
*E21B 47/09* (2012.01)

(52) U.S. Cl. ..... 166/255.1; 166/64; 166/214; 166/213

(58) Field of Classification Search ..... 166/255.1, 166/64, 231, 214, 213
See application file for complete search history.

(56) References Cited

U.S. PATENT DOCUMENTS 2,191,750 A * 2/1940 Brown ..... 166/63
2,451,472 A * 10/1948 Coggeshall ..... 166/253.1
2,476,137 A * 7/1949 Doll ..... 166/254.1
3,126,058 A * 3/1964 Yetman et al. ..... 166/63
4,067,386 A * 1/1978 Weise ..... 166/64
4,595,055 A * 6/1986 Vannier ..... 166/241.5
4,673,890 A * 6/1987 Copland et al. ..... 33/544.2
5,350,018 A * 9/1994 Sorem et al. ..... 166/250.07

OTHER PUBLICATIONS

Centralizer Specifications, Applied Electronic Systems, wwwl.aesla.com, publication date unknown.

* cited by examiner

*Primary Examiner* — Giovanna Wright
(74) *Attorney, Agent, or Firm* — Haynes and Boone, LLP

(57) ABSTRACT

Methods and devices are provided for accurately determining depths of certain structures in downhole strings. Locator tools comprise a shaft and a plurality of locator springs longitudinally mounted on the shaft. The locator springs are biased to expand and are configured to compress to allow the tool to traverse past restrictions in the downhole string. Each locator spring includes a locating pad that allows it to engage with an internal locating notch in the downhole string. The internal locating notch is sized to mate with the locator tool, i.e., to allow the locator springs to engage the internal locating notch. In this way, the depth of internal locating notches may be determined precisely and accurately by sensing engagement of the tool with the internal locating notch. Advantages of certain embodiments include more accurate depth determination, repeatable engagements of the tool, and reduced false engagements.

34 Claims, 3 Drawing Sheets

FIG.3

LOCATOR TOOL AND METHODS OF USE

BACKGROUND

The present application relates to downhole tools for depth detection in downhole strings and more particularly, depth identification of certain structures in downhole strings. Methods of use are also provided.

A variety of downhole operations require accurate identification of a precise location in a downhole string. Examples of operations that may require a specific location to be identified in a downhole string include perforation operations and cutting or severing operations (e.g. cutting a drill string or production string). Other applications requiring accurate depth identification include wellbore fluid sampling, temperature measurement, and pressure measurements. In some cases, the precision of depth identification required can be as small as around one foot or two feet.

Merely measuring the length of line extended while lowering a tool down a downhole string or pipe is usually insufficient for identifying a precise depth due to the effects of line stretch over long wellbore depths, which, in some cases, may extend several miles into the ground. In some cases, highly deviated wells further complicate measuring the line length deployed downhole. Although the amount of line stretch can be estimated in some circumstances, the uncertainties involved in these methods of estimation are often inadequate and consequently, such methods are often unsuccessful.

To aid in locating a precise location in a downhole string, specially designed spool pieces with internal notches may be installed in the casing string during completion. Because the precise location of the specially designed spool pieces are known with a high certainty, the internal notches of the specially designed spool pieces aid locating tools that are designed to interface with the internal notches of the specially designed spool pieces. Conventional mechanical locating devices, however, suffer from a number of disadvantages. For example, conventional mechanical locating devices, such as communication module (CM) locator tools, often have difficulty traversing various downhole restrictions in the pipe due to the relatively large size of conventional CM locator tools. For example, subsurface safety valves may inhibit the passing of a conventional CM locator tool.

Additionally, conventional mechanical locating devices are designed as engage-once devices, where the device activates once or latches in place at the desired internal notch. After initial deployment, the conventional mechanical locating device is unable to "reset" downhole for locating another desired locating notch or for repeating the same test. To reset such a device for subsequent measurements, operators must retrieve the prior art tool from the wellbore to reset the tool for another engagement or deployment.

In some cases, it may be desired to identify multiple depths in a downhole string or to take multiple loggings at the same depth for verification purposes. Because conventional locating devices are activate-once or engage-once devices incapable of being reset downhole for another activation, they are unsuitable for this purpose.

Another disadvantage of conventional devices are false engagements. This disadvantage is even more pronounced for devices that are limited to one engagement or one deployment per downhole trip because the device must be retrieved before being capable of performing another measurement. Accordingly, improved locating devices are needed to address one or more disadvantages of the prior art.

SUMMARY

The present application relates to downhole tools for depth detection in downhole strings and more particularly, depth identification of certain structures in downhole strings. Methods of use are also provided.

One example of a downhole depth locator system comprises an elongated tubular member having an inner surface and an outer surface, wherein a locating structure is formed on the inner surface of said tubular member; and a locator tool comprising: an elongated shaft; a plurality of locator springs attached to the shaft wherein the locator springs are parallel to and spaced about the shaft, wherein the locator springs are bow springs, wherein the locator springs are configured to compress to a first position and to expand to a second position; wherein the locator springs are biased to expand to the second position; wherein each locator spring includes a locating pad affixed thereto; wherein the locating pad is sized to engage with said internal locating structure; wherein the internal locating structure is sized to allow the locator springs to expand to the second position when said locating pad is engaged thereby; and a weigh indicator coupled to the locator tool, wherein the weigh indicator is configured to detect engagement of the locating pads with said internal locating structure.

One example of a method for determining depth in a downhole string comprising the steps of: providing a locator tool comprising a shaft, a plurality of locator springs attached to the shaft wherein the locator springs are parallel to and spaced about the shaft, wherein the locator springs are configured to compress to a first position and to expand to a second position, wherein the locator springs are biased to expand to the second position, wherein each locator spring includes a locating pad affixed thereto, wherein the locating pads are sized to engage with an internal locating notch, wherein the internal locating notch has a diameter sized to allow the locator springs to expand to the second position; coupling a line to the locator tool; coupling a weigh indicator to the line; introducing the locator tool into the downhole string; lowering the locator tool down the downhole string; allowing the locator tool to engage in the internal locating notch; and detecting a difference in weight held by the weigh indicator upon the locator tool engaging with the internal locating notch so as to produce a detection of engagement of the locator tool.

One example of a locator tool comprises a shaft; a plurality of locator springs attached to the shaft wherein the locator springs are parallel to and spaced about the shaft; wherein the locator springs are configured to compress to a first position and to expand to a second position; wherein the locator springs are biased to expand to the second position; wherein each locator spring includes a locating pad affixed thereto; wherein the locating pads are sized to engage with an internal locating notch; and wherein the internal locating notch has a diameter sized to allow the locator springs to expand to the second position.

One example of a multiple setting locator tool comprises an elongated shaft; at least one collar slidingly mounted on said shaft; a first spring biasing said collar in a first axial direction; a second spring biasing said collar in a second axial direction opposite the first axial direction; a locator pad mounted on said second spring, wherein said second spring biases said locator pad radially outward from said shaft.

The features and advantages of the present invention will be apparent to those skilled in the art. While numerous changes may be made by those skilled in the art, such changes are within the spirit of the invention.

BRIEF DESCRIPTION OF THE DRAWINGS

A more complete understanding of the present disclosure and advantages thereof may be acquired by referring to the following description taken in conjunction with the accompanying figures, wherein.

Figure 2A:
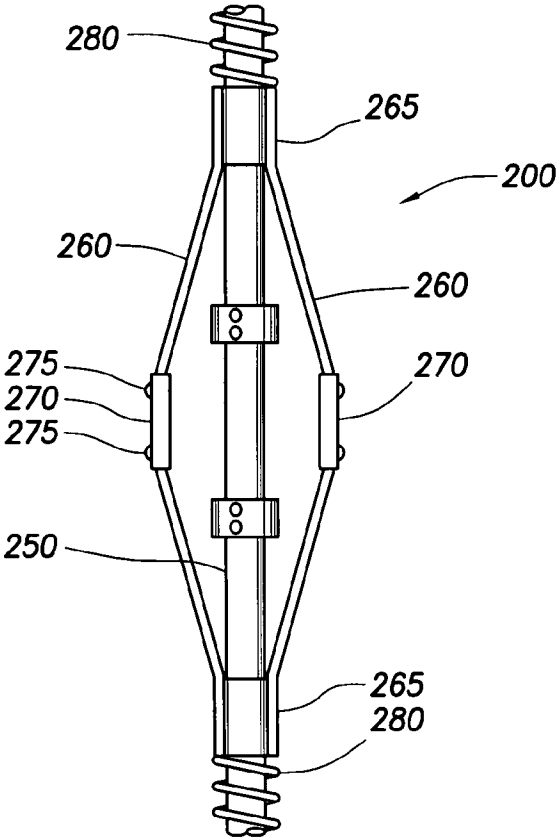
FIG. 2A illustrates a perspective view of one embodiment of a locator tool in accordance with one embodiment of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF PREFERRED EMBODIMENTS

The present application relates to downhole tools for depth detection in downhole strings and more particularly, depth identification of certain structures in downhole strings. Methods of use are also provided.

In certain embodiments, locator tools of the present invention comprise a shaft and a plurality of locator springs longitudinally mounted on the shaft. The locator springs are biased to expand radially outward and are configured to compress as the tool traverses past restrictions in a downhole string. Each locator spring includes a locating pad affixed thereto or mounted thereon, wherein each locating pad is sized to engage with an internal locating notch of the downhole string. The internal locating notch is sized to mate with the locator tool, that is, to allow the locator springs to expand to engage the internal locating notch. In this way, the depth of internal locating notches may be determined precisely and accurately by sensing engagement of the tool with the internal locating notch.

Locator tools may be used in conjunction with other downhole tools (e.g. perforation guns, cutting tools, sensors, etc) and optional secondary depth indicator devices (e.g. CCL devices and gamma ray logging tool) for additional redundancy. Advantages of certain embodiments include, but are not limited to, more accurate and precise depth determination in downhole strings, the ability to repeatedly engage locator tools without having to retrieve the tool from the wellbore, and reduced false engagements.

Locator tools of the present invention are not only capable of determining depths of specific points in a downhole string, but may also use identified downhole structures as reference points for other downhole operations.

To facilitate a better understanding of the present invention, the following examples of certain embodiments are given. In no way should the following examples be read to limit, or define, the scope of the invention.

Figure 1:
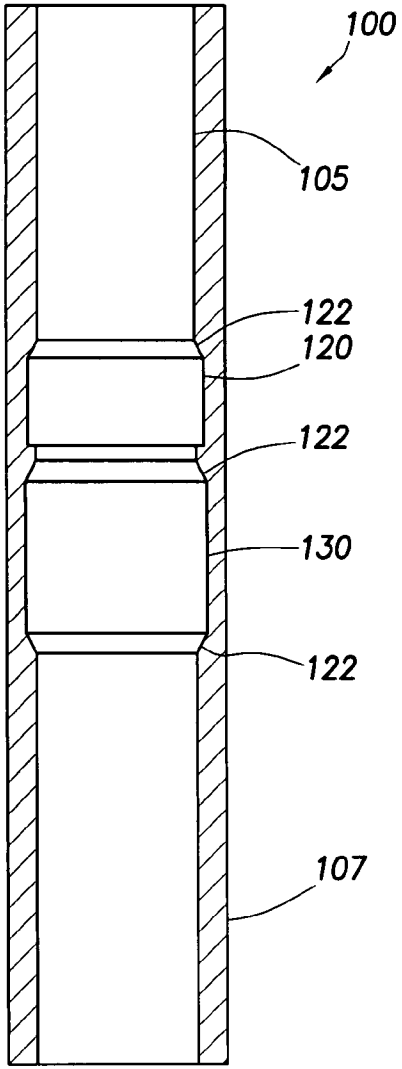
FIG. 1 illustrates a side view of a length of downhole tubing with a specially designed spool piece having an internal locating notch therein.

FIG. 1 illustrates a side view of a length of downhole tubing with a specially designed spool piece having an internal locating notch therein. Downhole string 100 is comprised of multiple sections of tubing 105 run in well bore 107. Downhole string 100 has incorporated therein one or more internal locating notches, in this case, first internal locating notch 120 and second internal locating notch 130. Internal locating notches 120 and 130 are specially designed spool pieces which provide an expanded section of tubing or pipe in which locator tools (not shown) may engage. That is, locator tools of the present invention are configured to engage in an expanded section of tubing or pipe, such as first internal locating notch 120 and second internal locating notch 130. Internal locating notches 120 and 130 may include angled edges 122 to facilitate engagement and disengagement of locator tools (not shown).

FIG. 2A illustrates a perspective view of one embodiment of a locator tool in accordance with one embodiment of the present invention. Locator tool 200 comprises shaft 250 and locator springs 260. Locator springs 260 further comprise locating pads 270 which are sized to interact with, engage with, or otherwise mate with internal locating notches similar to one of internal locating notches 120 and 130 depicted in FIG. 1. Locator springs 260 radially compress as locator tool 200 traverses through restrictions in a downhole string. Upon encountering an expansion section, such as an internal locating notch, locator springs 260 expand radially outward so as to allow locator tool 200 to engage in the internal locating notch. As locating pads 270 are sized to engage the height of the internal locating notch, locator tool 200 is capable of seating in the internal locating notch.

Locator springs 260 may be any biasing mechanism that resists compression and which compress to allow a locator tool to pass through a restriction in a downhole string. Examples of suitable locator springs, include, but not limited to, flat springs, leaf springs, bow springs 260 such as those depicted in FIG. 2A, or roller-articulated locator springs 261 as depicted in FIG. 2B.

Returning to FIG. 2A, locator springs 260 are slidingly mounted on shaft 250 via collar mounts 265. Each collar mount 265 is acted upon by an adjustable tension spring 280. Adjustable tension springs 280 can be used to vary the biasing force of locator springs 260. Increasing the compression of springs 280 via an adjustment mechanism, such as an adjustable nut, for example, alters the force required to disengage locator tool 200 from an internal locating notch. In certain embodiments, axial forces of up to 50 pounds may be required to disengage locator tool 200 from an internal locating notch. Tension spring 280 may be secured in place on shaft 250 my any standard means. In one embodiment, a backstop may be secured to shaft 250 so that tension spring 280 abuts the back stop. The relative position of said backstop relative to shaft 250 may be altered in order to adjust tension spring 280. For example, the back stop may be a collar with one or more fasteners to secure it in non-sliding position on shaft 250. Alternatively, the backstop may be an integrally formed shoulder or similar structure of shaft 250.

Figure 2C:
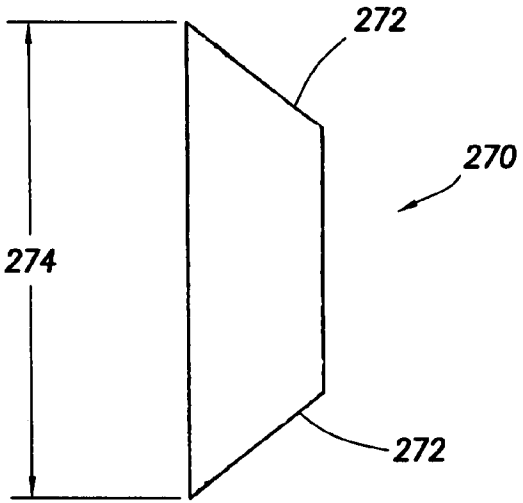
FIG. 2C is a close-up profile view of one embodiment of a locating pad having angled edges.
Figure 2B:
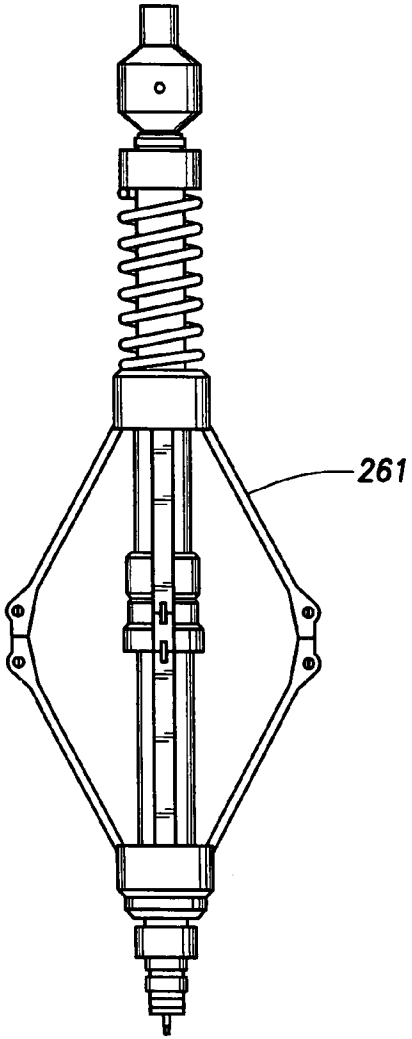
FIG. 2B illustrates an alternate embodiment of a locator tool having roller-articulated locator springs.

FIG. 2C is a close-up profile view of one embodiment of a locating pad having angled edges. Angled edges 272 facilitate the engagement and disengagement of locating pad 270 from a corresponding internal locating notch. Height 274 is designed so as to facilitate mating of locating pad 270 with a corresponding internal locating notch.

While tool 200 is shown with four spring/pad structures equally spaced around shaft 250, those skilled in the art will appreciate that any number of spring/pad structures may be used. In one embodiment, the larger number of spring/pad structures may enhance the ease in locating a locating notch or other structure.

Likewise, while two mounts 265 are shown, those skilled in the art will appreciate that only a single slidable mount 265 may be utilized. A first end of spring 260 may be fixed in place on shaft 250 while a second end of spring 260 is attached to slidable mount 265. Other embodiments may utilized a spring 260 fixed at both ends.

In yet another embodiment of the invention, electrical sensors may be incorporated either along shaft 250 to sense movement of mounts 265 or adjacent spring 260 to sense compression or expansion thereof. Thus, for example, when run into a wellbore, mounts 265 may be in a first position along shaft 250 when the tool 200 is passing through the standard internal diameter of a casing string. However, when locating pads 270 engage an internal structure along a casing string, spring 260 will expand radially outward, thereby causing mounts 265, under bias from springs 280, to move axially along shaft 250 to another position. An electrical sensor can be used to detect the relative movement of mounts 265 on shaft 250. If the relative movement of mounts 265 when pads 270 are seated in a desired internal structure are known, such sensors can be used to distinguish between a "seating" event and merely a change in the internal diameter of the casing string. Likewise, the foregoing may also be used to identify other changes in the diameter of the casing string. For example, if tool 201 passes through a constricted portion of a casing string, mounts 265 will be caused to move axially away from one another along shaft 250.

Figure 3:
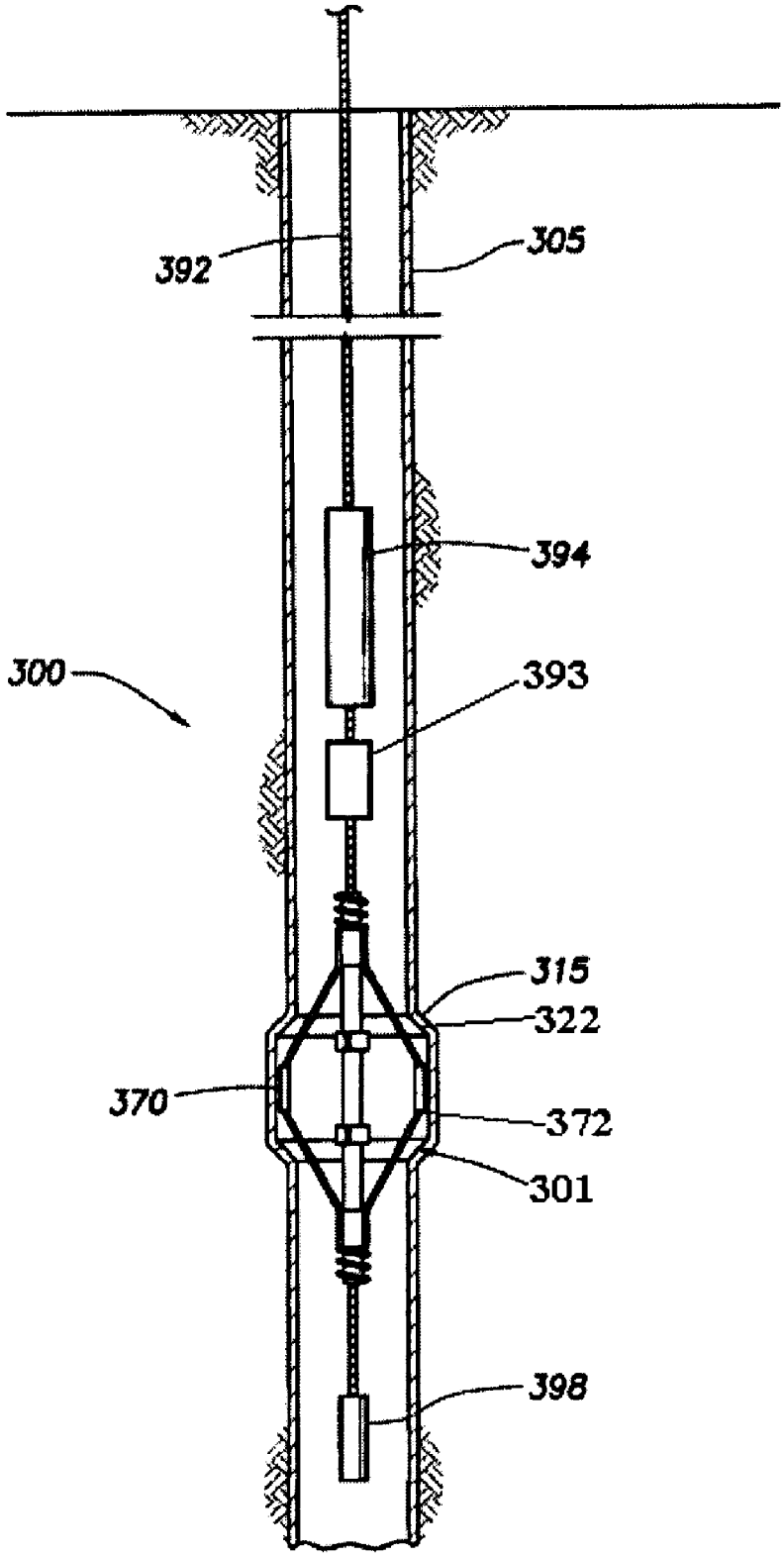
FIG. 3 illustrates a cutaway side view of a locator tool engaging an internal locating notch in a downhole string in accordance with one embodiment of the present invention.

FIG. 3 illustrates a cutaway side view of a locator tool 301 engaging an internal locating notch in a downhole string in accordance with one embodiment of the present invention.

Downhole string 300 comprises internal locating notch 315. As before, internal locating notch 315 is a tubular section having a diameter, volume or internal surface characteristic different than that of the surrounding tubing 305. In this embodiment, internal locating notch 315 has a diameter greater than surrounding tubing 305. In this way, internal locating notch 315 provides a section of pipe in which locator tool 301 can seat, interface with, or otherwise mate with. The height of locating pads 370 are configured to preferentially seat in internal locating notch 315.

To determine the depth of internal locating notch 315, locator tool 301 may be lowered via line 392 down downhole string 300 until reaching internal locating notch 315. In an embodiment, locator tool 301 may be lowered at a descent rate of approximately 35 feet per minute. Line 392 may be a slickline or a wireline as desired. Once locator tool 301 engages and seats in internal locating notch 315, this engagement may be sensed and communicated to other secondary downhole tools or to the surface. One method of sensing engagement of locator tool 301 includes, but is not limited to weigh indicator 393 registering a decrease in weight when locator tool 301 is seated and therefore supported, at least partially, by internal locating notch 315. This depth determination may be communicated to the surface by any means known in the art including by transmission through a wireline where line 392 is a wireline.

To disengage locator tool 301 from internal locating notch 315, slack joint 394 provides the necessary impetus to dislodge tool 301 from notch 315. Locator tool 301 may then be run further down string 300 to determine the depth of another internal locating notch by engagement therein. Alternatively, locator tool 301 may be raised to reengage uphole internal locating notch 315 for confirmation of the earlier depth determination. Locator tool 301 may be raised by action of slack joint 394 or by retrieval of line 392 as desired.

Once a depth has been satisfactorily determined and optionally logged, the depth determination may be used as a reference point for other secondary operations. For example, optional secondary tool may be used to perform other downhole operations. Examples of suitable secondary tools include, but are not limited to, perforation guns, cutting or severing tools, fluid sampling devices, logging devices, temperature and/or pressure sensors, or any combination thereof.

Secondary depth measurement device 398 may provide additional redundant data regarding downhole depth so as to provide an independent verification of the depth determinations of locator tool 301.

In certain embodiments, a force of about 30 to about 80 pounds is required to unseat or disengage locator tool 301 from internal locating notch 315. In other embodiments, a force of about 50 pounds is required. Angled edges 322 of internal locating notch 315 and angled edges 372 of locating pads 370 facilitate the engagement and disengagement of locator tool 301 with internal locating notch 315.

It is explicitly recognized herein that locating pads 370 are not limited to any specific shape or configuration. Instead, locating pads 370, when provided, are sized to preferentially interface with a structure, preferably corresponding in shape, on internal locating notch 315. In certain embodiments, locating pads 370 may further comprise roller balls 275 to reduce friction. In other embodiments, locating pads 370 may be constructed of a low friction material, such as, for example, PVC or nylon pads. Those skilled in the art will appreciate that the purposes of the invention are achieved so long as pads 370 are smaller than the structure in which they are intended to seat, thereby permitting an outward radial expansion to some degree so as to permit the identification of a locating structure.

While in the foregoing embodiments of the invention, locating notch 315 is discussed primarily as extending around the full inner diameter of downhole string 300, it need not. In one embodiment of the invention, locating notch 315 may be positioned on only a portion of the diameter so that engagement by pad 370 can be used to establish the orientation of tool 301 relative to the casing. For example, tool 301 may be provided with only a single spring/pad structure, and the casing may include a locating structure at only a specific point on the internal diameter of the casing. As such, when the spring/pad structure seats in the locating structure, not only is the dept of the tool in the wellbore established, but also the radial orientation of tool 301. Such an embodiment is desirable in cases where precise placement of another tool, such as a perforating gun, is desirable.

In this same vein, a succession of collars 365 may be disposed on shaft 350, with a spring 360/pad 370 structure disposed between each set of collars, albeit at a radial angle displaced from one another. In this way, the likelihood of engaging a locating structure disposed on only a portion of the diameter is increased, while the ability to precisely determine the radial orientation of the tool is maintained. Such an embodiment may also be combined with the foregoing electrical sensors for the mounts to identify which of the spring/pad structures is thus seated.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee.

What is claimed is:

1. A downhole depth locator system comprising:

an integrally formed, singular elongated tubular member having an inner surface and an outer surface and extending between a first end of the tubular member and a second end of the tubular member, wherein a locating structure is formed along the inner surface of said tubular member between the first and second ends; and a locator tool comprising:

an elongated shaft;

a plurality of locator springs attached to the shaft wherein the locator springs are substantially parallel to and spaced about the shaft;

wherein the locator springs are configured to compress to a first position and to expand to a second position;

wherein the locator springs are biased to expand to the second position;

wherein each locator spring includes a locating pad affixed thereto;

wherein the locating pad is sized to engage with said internal locating structure;

wherein the internal locating structure is sized to allow the locator springs to expand to the second position when said locating pad is engaged thereby; and a sensor for measuring the compression or expansion of at least one locator spring.

2. The locator system of claim 1 further comprising a secondary depth indicator wherein the secondary depth indicator is a casing collar locator or a gamma ray logging tool.

3. The locator system of claim 2 further comprising a secondary downhole tool wherein the secondary downhole tool is a perforation gun, a cutting tool, a pressure sensor, a temperature sensor, or any combination thereof.

4. The locator system of claim 3 wherein the locating pads further comprise one or more roller balls so as to reduce friction between the locating pads and the downhole tubular member.

5. The locator system of claim 4 further comprising a weigh indicator coupled to the shaft by a line wherein the weigh indicator is configured to detect a difference in weight held by the line upon the locating pads engaging with the internal locating structure.

6. A downhole depth locator system comprising:

an elongated tubular member having an inner surface and an outer surface, wherein a locating structure is formed on the inner surface of said tubular member; and a locator tool comprising:

an elongated shaft;

a plurality of locator springs attached to the shaft wherein the locator springs are parallel to and spaced about the shaft;

wherein the locator springs are bow springs;

wherein the locator springs are configured to compress to a first position and to expand to a second position;

wherein the locator springs are biased to expand to the second position;

wherein each locator spring includes a locating pad affixed thereto;

wherein the locating pad is sized to engage with said internal locating structure;

wherein the internal locating structure is sized to allow the locator springs to expand to the second position when said locating pad is engaged thereby;

a weigh indicator coupled to the locator tool, wherein the weigh indicator is configured to detect engagement of the locating pads with said internal locating structure;

a secondary depth indicator wherein the secondary depth indicator is a casing collar locator or a gamma ray logging tool;

a secondary downhole tool wherein the secondary downhole tool is a perforation gun, a cutting tool, a pressure sensor, a temperature sensor, or any combination thereof; and a slack joint configured to facilitate disengagement of the locating pads from the internal locating structure.

7. A method for determining depth in a downhole string comprising the steps of:

providing an integrally formed, singular elongated tubular member having an inner surface and an outer surface and extending between a first end of the tubular member and a second end of the tubular member, wherein a locating structure is formed along the inner surface of said tubular member between the first and second ends;

providing a locator tool comprising a shaft, at least one collar slidingly mounted on the shaft; a plurality of locator springs attached to the collar wherein the locator springs are substantially parallel to and spaced about the shaft, wherein the locator springs are configured to compress to a first position and to expand to a second position, wherein the locator springs are biased to expand to the second position, wherein each locator spring includes a locating pad affixed thereto, wherein the locating pads are sized to engage with the internal locating structure, wherein the internal locating structure has a diameter sized to allow the locator springs to expand to the second position;

coupling a line to the locator tool;

positioning the elongated tubular member in the downhole string;

introducing the locator tool into the down hole string;

lowering the locator tool down the downhole string;

and measuring the relative movement between said collar and said shaft to determine when the locator tool has engaged the internal notch.

8. A method for determining depth in a downhole string comprising the steps of:

providing a locator tool comprising a shaft, a plurality of locator springs attached to the shaft wherein the locator springs are parallel to and spaced about the shaft, wherein the locator springs are configured to compress to a first position and to expand to a second position, wherein the locator springs are biased to expand to the second position, wherein each locator spring includes a locating pad affixed thereto, wherein the locating pads are sized to engage with an internal locating notch, wherein the internal locating notch has a diameter sized to allow the locator springs to expand to the second position;

coupling a line to the locator tool;

coupling a weigh indicator to the line;

introducing the locator tool into the downhole string;

lowering the locator tool down the downhole string;

allowing the locator tool to engage in the internal locating notch;

detecting a difference in weight held by the weigh indicator upon the locator tool engaging with the internal locating notch so as to produce a detection of engagement of the locator tool; and providing a slack joint coupled to the line and allowing the slack joint to disengage the locator tool from the internal locating notch.

9. The method of claim 8 further comprising raising the locator tool using the slack joint so as to reengage in the internal locating notch.

10. The method of claim 8 wherein the step of lowering is at a descent rate of no more than about 35 feet/minute.

11. The method of claim 8 wherein the line is a wireline and further comprising communicating the detection of engagement through the wireline and logging the detection.

12. A downhole depth locator system comprising:

an integrally formed, singular elongated tubular member having an inner surface and an outer surface and extending between a first end of the tubular member and a second end of the tubular member, wherein a locating structure is formed along the inner surface of said tubular member between the first and second ends;

a locator tool comprising;

a shaft; and a plurality of locator springs attached to the shaft wherein the locator springs are parallel to and spaced about the shaft;

wherein the locator springs are configured to compress to a first position and to expand to a second position;

wherein the locator springs are biased to expand to the second position;

wherein each locator spring includes a locating pad affixed thereto;

wherein the locating pads are sized to engage with the internal locating structure;

wherein the internal locating structure has a diameter sized to allow the locator springs to expand to the second position; and a slack joint configured to facilitate disengagement of the locating pads from the internal locating structure.

13. The locator system of claim 12 wherein the locator springs are bow springs.

14. The locator system of claim 12 wherein the locator springs are roller articulated springs.

15. The locator system of claim 12 further comprising a weigh indicator coupled to the shaft by a line wherein the weigh indicator is configured to detect a difference in weight held by the line upon the locating pads engaging with the internal locating structure.

16. The locator system of claim 15 wherein the line is a slickline or a wireline.

17. The locator system of claim 12 further comprising a secondary downhole tool wherein the secondary downhole tool is a perforation gun, a cutting tool, a pressure sensor, a temperature sensor, or any combination thereof.

18. The locator system of claim 12 wherein the locating pads comprise sloping angles at each end of the locating pads to facilitate mechanical engagement and disengagement of locating pads with the internal locating structure.

19. The locator system of claim 12 wherein during engagement of the locating pads with the internal locating structure, the locator tool is configured to resist disengagement from the internal locating structure up to at least about 50 pounds of force.

20. The locator system of claim 12 wherein each locator spring has a tension and wherein the tension is adjustable.

21. The locator system of claim 12 wherein each end of each locator spring is slidingly mounted to the shaft and further biased to expand by one or more coiled springs longitudinally mounted on the shaft wherein each coiled spring acts upon each locator spring.

22. The locator system of claim 12 wherein each locator spring has a tension and wherein the tension is adjustable by compressing the one or more coiled springs.

23. The locator system of claim 12 wherein the locator spring is configured to compress continuously from the second position to the first position in direct proportion to the lateral force applied on the locating pads.

24. A locator tool comprising:

a shaft;

a plurality of locator springs attached to the shaft wherein the locator springs are parallel to and spaced about the shaft;

wherein the locator springs are configured to compress to a first position and to expand to a second position;

wherein the locator springs are biased to expand to the second position;

wherein each locator spring includes a locating pad affixed thereto;

wherein the locating pads are sized to engage with an internal locating notch;

wherein the internal locating notch has a diameter sized to allow the locator springs to expand to the second position;

a secondary depth indicator wherein the secondary depth indicator is a casing collar locator or a gamma ray logging tool;

a secondary downhole tool wherein the secondary downhole tool is a perforation gun, a cutting tool, a pressure sensor, a temperature sensor, or any combination thereof; and a slack joint configured to facilitate disengagement of the locating pads from the internal locating notch.

25. The locator tool of claim 24 wherein the locating pads further comprise one or more roller balls so as to reduce friction between the locating pads and the downhole string.

26. A multiple setting downhole depth locator system comprising:

an elongated tubular member characterized by an integrally formed, singular wall extending between a first end of the elongated tubular member and a second end of the elongated tubular member, the wall having an inner surface and an outer surface, wherein a locating structure is formed along the inner surface of the wall of the said tubular member;

a locator tool comprising;

an elongated shaft;

at least one collar slidingly mounted on said shaft;

a first spring biasing said collar in a first axial direction;

a second spring biasing said collar in a second axial direction opposite the first axial direction;

a locator pad mounted on said second spring, wherein said second spring biases said locator pad radially outward from said shaft; and a sensor for measuring the relative movement between said collar and said shaft;

wherein the locating pad is sized to engage with the internal locating structure.

27. The locator system of claim 26, wherein said second spring is a bow spring having a first end and a second end, wherein said first end of said bow spring is attached to said collar and the second end of said bow spring is attached adjacent said shaft at a location removed from said collar.

28. The locator system of claim 27, wherein further comprising a second collar slidingly mounted on said shaft, wherein the second end of said bow spring is attached to said second collar.

29. The locator system of claim 28, further comprising a third spring biasing said second collar in the second axial direction.

30. The locator system of claim 29, further comprising first and second backstops against which each of said first and third springs abuts, respectively.

31. The locator system of claim 27, wherein said second spring comprises a first portion and a second portion, wherein the first portion includes said first end and extends between said collar and said pad and wherein said second portion includes said second end and extends between said pad and said attachment point adjacent said shaft.

32. The locator system of claim 26, further comprising four second springs and four locator pads, each spring locator pad spaced around the periphery of said elongated shaft.

33. The locator system of claim 26, further comprising a plurality of collars, slidingly mounted on said shaft and spaced apart from one another and a plurality of second springs, wherein at least one second spring is disposed between each of said plurality of collars and each of said second springs has a locator pad mounted thereon so that said locator pad is biased radially outward from said shaft.

34. The locator system of claim 33, wherein said plurality of second springs are radially positioned around the periphery of said shaft at spaced apart radial locations.

* * * * *